US005309746A

United States Patent [19]

Abbey, III

[11] Patent Number: 5,309,746

[45] Date of Patent: May 10, 1994

[54] AUTOMATIC TUBE STRAIGHTENING SYSTEM

[75] Inventor: Nelson D. Abbey, III, Monclova, Ohio

[73] Assignee: Abbey Etna Machine Company, Perrysburg, Ohio

[21] Appl. No.: 10,290

[22] Filed: Jan. 28, 1993

[51] Int. Cl.[5] ..... B21D 3/05

[52] U.S. Cl. ..... 72/9; 72/12; 72/162; 72/164

[58] Field of Search ..... 72/160, 162, 164, 165, 72/129, 34, 9, 12

[56] References Cited

U.S. PATENT DOCUMENTS 4,663,955 5/1987 Redman ..... 72/160

FOREIGN PATENT DOCUMENTS 3414486 10/1985 Fed. Rep. of Germany ..... 72/165
3729619 3/1989 Fed. Rep. of Germany ..... 72/34
232017 10/1986 Japan ..... 72/164
293612 12/1986 Japan ..... 72/160
142618 5/1990 Japan ..... 72/34

*Primary Examiner*—Daniel C. Crane
*Attorney, Agent, or Firm*—Marshall & Melhorn

[57] ABSTRACT

A system is provided for assuring the straightness of pipes or tubes produced by a continuous seam-welded process. Following sizing, the newly formed continuous tube passes through a straightening unit and a preliminary alignment checker. The alignment checker observes the actual spatial position of the advancing tube, and the straightening unit is adjusted in response to deviations of the observed position from the predetermined desired path to deform the tube so that it conforms to the desired path. The advancing continuous tube is then severed into individual tube sections of desired length, and some or all of the sections are inspected for straightness. In inspecting for straightness the individual sections are rotated about their longitudinal axes to place the seam-weld in a predetermined position for correlating the angular attitude of the section with that of the advancing continuous tube. Deflection of the midregion of the individual tube relative to the ends is observed along orthogonal axes, and the straightening unit is adjusted in response to the magnitude and direction of observed deviation of the tube from straightness. The straightener appropriately deforms the advancing continuous tube to minimize curvature in subsequent individual sections. Inspected sections falling outside acceptable standards for straightness may be provided with an identifying indicia.

20 Claims, 3 Drawing Sheets

AUTOMATIC TUBE STRAIGHTENING SYSTEM

BACKGROUND OF THE INVENTION

1. Field of the Invention

The present invention relates generally to the manufacture of continuous seam-welded metal tubes or pipes, and more particularly to a system for observing the axial alignment of the pipe or tube as it is fabricated and continuously correcting the alignment in response to observed deviations so as to produce tubes having a high degree of axial alignment or straightness.

2. Description of the Prior Art

In accordance with a well-known procedure for fabricating seam-welded pipes and tubes, a continuous strip or skelp is advanced through a forming apparatus and progressively deformed into a tubular form having an open, longitudinally extending seam. The tubular form then advances through a welding station wherein the adjacent longitudinal free edges are urged together and joined by a suitable welding process. The particular process to be employed will generally be dictated by, among other factors, the material from which the tube or pipe is formed. For example, the pipe may be formed of low carbon steel, stainless steel, aluminum, etc., and the welding process may include any of the well-known welding techniques conventionally employed with the various materials. In a widely used embodiment the tube or pipe is heated by electrical induction so that the edges achieve fusion temperature, and the heated edges are urged into engagement to produce a continuous monolithic welded seam.

Following the welding step, the pipe or tube may advance through a scarfing unit for removal of the raised bead created incident to the formation of the welded seam, and then through a series of sizing rolls for imparting the precise diameter and cross-sectional configuration to the formed pipe. Finally, after the continuous pipe has been sized and cooled, it enters a cut-off mechanism wherein it is cut into sections of appropriate length.

Due, among other factors, to residual stresses in the material following formation of the pipe, and the heating and cooling incident to the welding of the seam, the pipe may tend to warp or snake and develop an undesirable non-linear configuration as it exits the constraints of the forming and welding mechanism. In order to minimize the amount of this curvature in the finished product, the pipe or tubing is directed through a straightening unit wherein appropriate forces are applied by straightening rolls to bend the pipe to compensate for existing curvature and cause it to assume a linear profile as it exits the forming apparatus. Heretofore, the pipe has been observed at some distance downstream from the straightening unit by an operator to visually determine the amount and orientation of existing curvature, and the straightening unit then manually adjusted in response to the observed condition to compensate for the curvature. The procedure functions well for its intended purpose, and permits production of pipe of good quality. However, it has not been found entirely satisfactory in that it is dependent upon the operator's visual observation and subsequent manual adjustment of the straightening unit. It is thus subject to the operator's judgment, as well as human error. In addition, deviation of the pipe is best observed at some distance downstream from the straightening unit, typically in the cut-off area. Since the pipe advances at a relatively rapid rate, a significant amount of defective pipe may be produced between the time at which deviation is noted and corrective action can be taken at the straightening unit.

SUMMARY OF THE INVENTION

In accordance with the present invention, the aforementioned deficiencies of the prior art devices are overcome. An alignment sensor is provided immediately downstream from the straightening unit for continuously precisely determining the position of the advancing pipe relative to reference axes. Signals indicative of the observed position of the pipe relative to a predetermined desired position are generated, and the straightening unit is adjusted in response to the generated signals to shape the pipe so that it advances through the alignment sensor at the desired position.

In order to further insure the straightness of the pipe being produced, following severing of the continuous pipe into individual sections, some or all of the individual sections may be checked for straightness. The straightening unit is adjusted in response to observed deviations from straightness to insure that the finished product is within precise limits of axial straightness. To that end, following severance from the continuous pipe the individual pipe sections are received on a deflection checker. The section is rotated about its longitudinal axis to position the weld seam at a predetermined position for reference purposes by means of a seam locator. With the seam position thus determined, deviation from straightness of the mid region of the pipe section is determined along orthogonal axes. Signals indicative of the direction and magnitude of deflection, or bow, are generated and transmitted to the straightening unit. The straightening unit is adjusted in response to the signals so as to correctly shape the continuous pipe to eliminate, or at least minimize, any deflection or bow in subsequent individual sections.

BRIEF DESCRIPTION OF THE DRAWINGS

In the drawings, wherein the numerals are employed to designate like parts through the same.

DESCRIPTION OF THE PREFERRED EMBODIMENT

Figure 1:
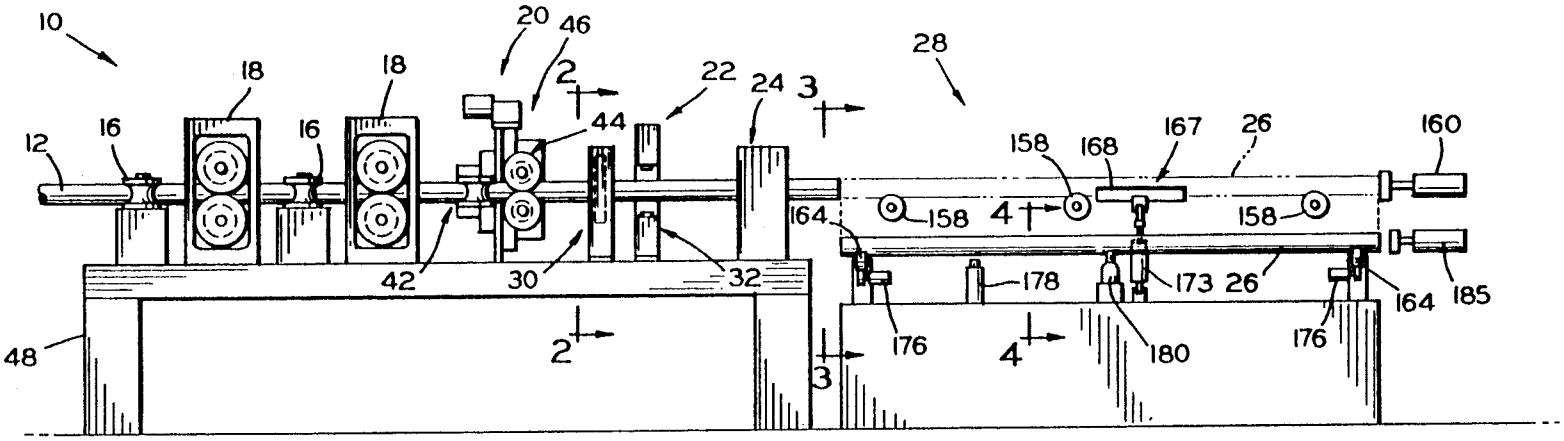
FIG. 1 is a schematic side elevational view of a portion of a line for producing continuous seam welded pipe or tubing and embodying the invention.
Figure 2:
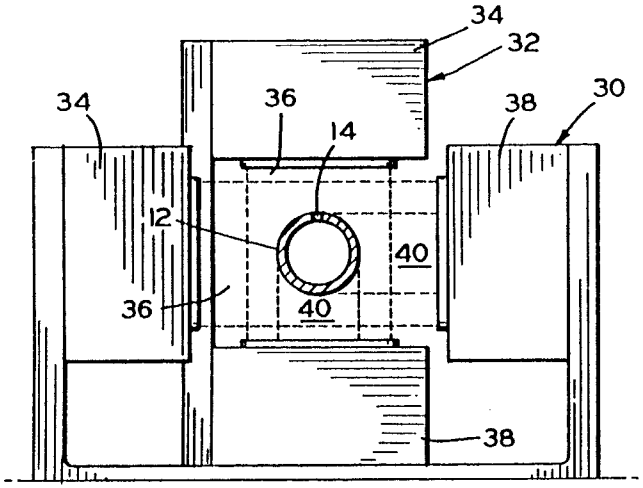
FIG. 2 is an enlarged elevational view taken substantially along line 2—2 of FIG. 1.
Figure 3:
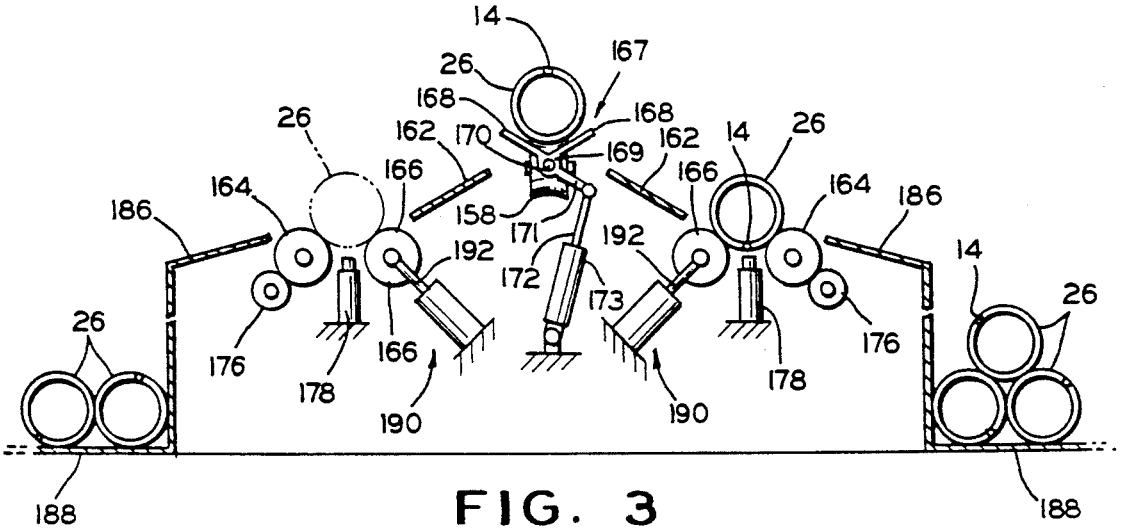
FIG. 3 is an enlarged schematic elevational view taken substantially along line 3—3 of FIG. 1.
Figure 4:
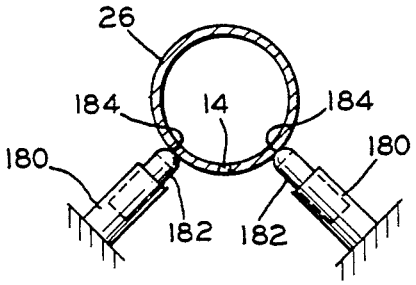
FIG. 4 is an enlarged transverse sectional view, taken substantially along line 4—4 of FIG. 1.

With reference to FIG. 1, there is shown schematically and identified generally at 10 therein a portion of a conventional tube forming mill embodying the invention. In such mills, as described, for example, in U.S. Pat. No. 5,148,960, a continuous metal strip or skelp is advanced through a series of opposed forming rolls and side closing rolls (not shown) whereby it is progressively bent into tubular form. The formed blank then advances through a welding station (not shown) wherein the opposed free edges of the blank are suitably welded or fused to produce a continuous tube 12 having a seam weld 14 (FIGS. 2, 3 and 4). Thereafter the tube is cooled and advances through a series of side closer rolls 16 and sizing stands 18 for final working and sizing.

As shown in FIG. 1, following final sizing by the sizing stands 18 the completed continuous tube advances successively through a straightener device, such as a so-called Turkshead unit shown generally at 20, and an alignment checker 22, and into a conventional cut-off unit 24. Within the cut-off unit the advancing tube 12 is severed transversely into individual sections 26 of predetermined length. The individual sections then advance to a final checking unit, shown generally at 28, for determination of the amount and orientation of any deviation from straightness which may be present in the section. This information is then fed back to the straightener unit 20 and utilized for precisely setting the unit to eliminate such deviation in subsequent sections 26.

The alignment checker 22 is located adjacent the straightener 20, and thus quickly detects any tendency for the tube 12 to deviate from the desired path and develop a non-linear condition. Data provided by the alignment checker is utilized for setting the straightener 20 to direct the tube along the prescribed path through the checker. The non-linear condition is thus preliminarily corrected. Further and more precise correction may be provided by setting the straightener in response to signals provided by the final checking unit 28 from observation of the individual pipe sections 26. Production of pipe sections 26 within acceptable tolerances for straightness is thus assured.

The alignment checker 22 may, of course be of any suitable type which will determine the actual position of the pipe or tube 12 relative to a predetermined desired position of alignment and generate a signal indicative of the magnitude and direction of any displacement from the desired position. For example, the checker may be in the form of any of a number of well-known mechanical or optical position sensing devices. In a preferred embodiment as shown in FIGS. 1 and 2, the alignment checker comprises a pair of laser scanner units 30 and 32 positioned to determine the actual horizontal and vertical position, respectively, of the pipe 12 relative to a desired reference axis. Very suitable units are available commercially, for example, from Zumbach Electronic Corp., 140 Kisco Avenue, Mount Kisco, N.Y. 10549.

As best seen in FIG. 2, such units include an emitter 34 directing a scanning laser beam 36 transversely across the tube 12. A receiver 38 is positioned opposite the tube to intercept the laser beam and discriminate the position of a shadow 40 cast by the tube by means of a built-in microprocessor (not shown). The microprocessor generates signals indicative of the actual horizontal and vertical position of the tube relative to the desired reference position and transmits the signals to a central control computer as will be hereinafter described. While the alignment checker has been illustrated as including separate horizontal and vertical scanner units 30 and 32, it is contemplated that the two units may as well be incorporated in a single measuring head.

The straightener unit 20 is adapted to appropriately deform the tube 12 in response to data provided by the alignment checker 22 as well as the final checking unit 28 so as to produce a finished product having minimal linear distortion. To that end the straightener unit includes first and second pairs of cooperating opposed guide rollers 42 and 44, disposed within a support framework shown generally at 46 mounted upon a base structure 48, and defining a confined path along which the tube 12 is conveyed. The pairs or sets of rollers are disposed along axes generally perpendicular to one another. For example, in the illustrated embodiment the pair 42 is oriented horizontally while the pair 44 is oriented vertically. The advancing tube 12 is confined between the rollers of each pair, with the pair 42 being laterally adjustable and the pair 44 being vertically adjustable to cooperatively apply appropriate deforming forces to the tube.

Figure 5:
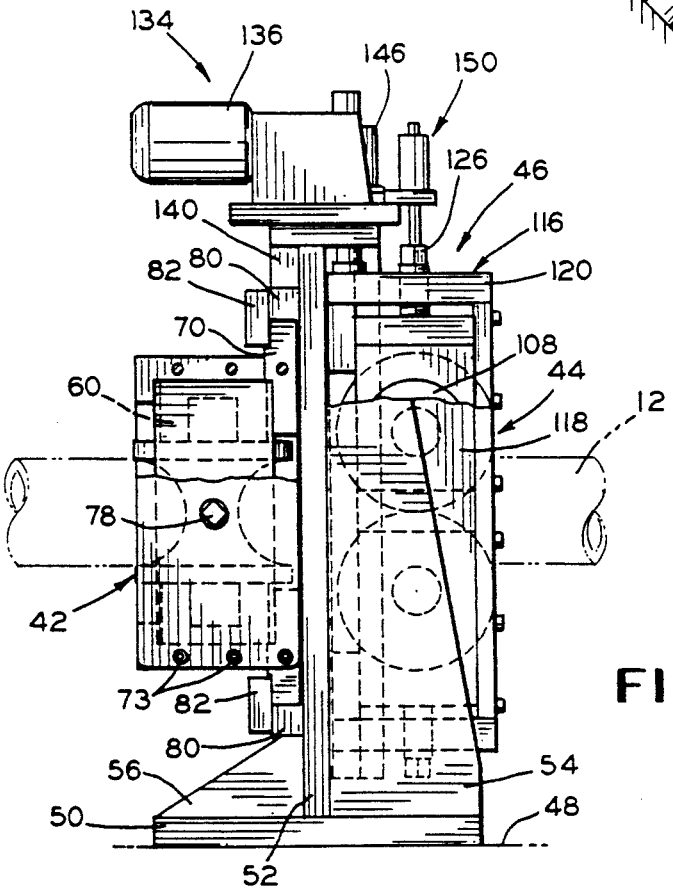
FIG. 5 is an enlarged side elevational view of the straightening unit of the invention illustrated in FIG. 1.
Figure 6:
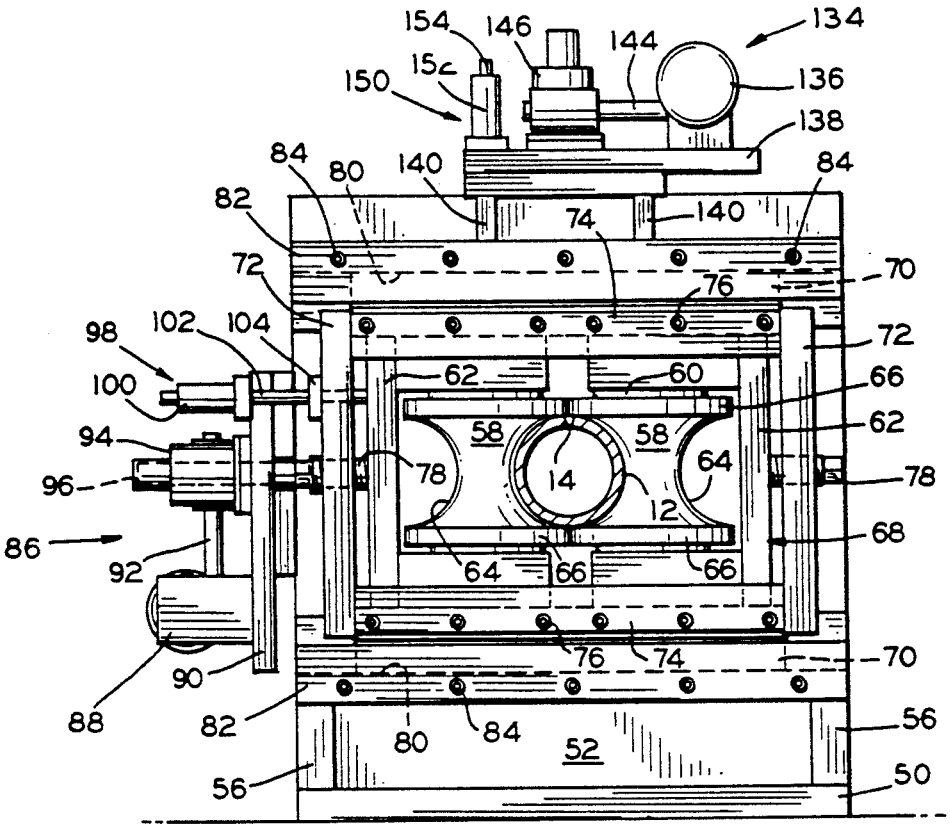
FIG. 6 is an end elevational view of the straightening unit as seen from the left in FIG. 5.
Figure 7:
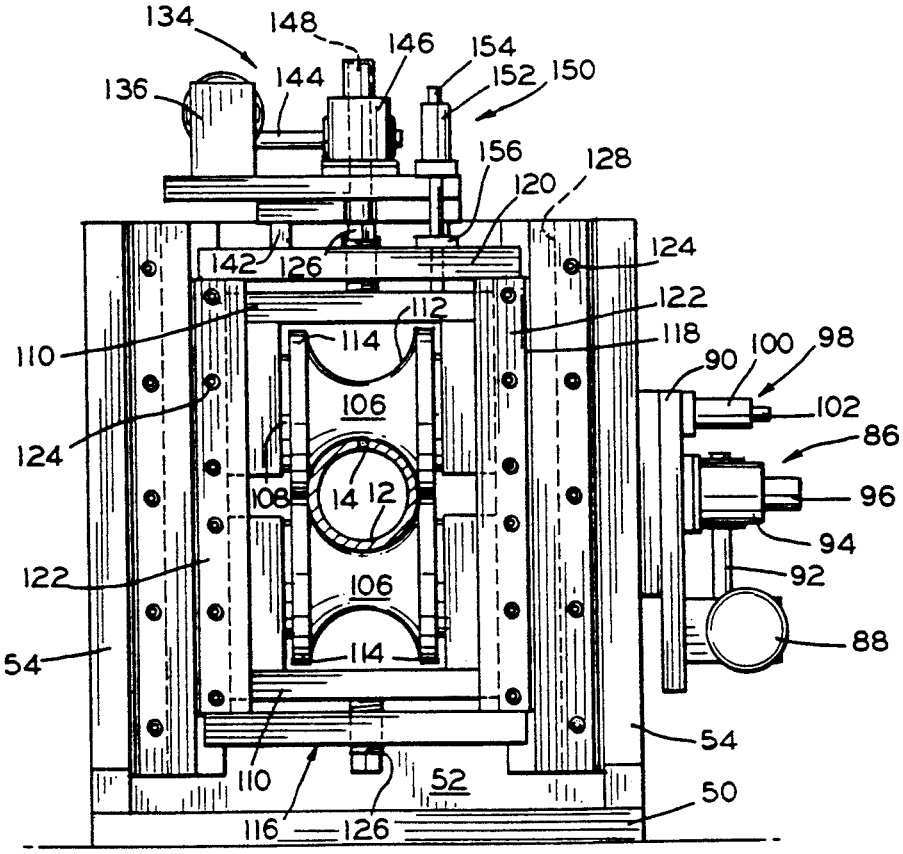
FIG. 7 is an end elevational view of the straightening unit as seen from the right in FIG. 5.

As best seen in FIGS. 5, 6 and 7, the framework 46 of the straightener comprises a base plate 50 upon which an upstanding carrier plate 52 is mounted. The carrier plate is supported in the upright position by brace plates 54 and straightening gussets 56 affixed to the base plate and the carrier plate.

The guide roller sets 42 and 44 and the mounting and adjustment mechanisms therefore are of generally similar construction. More particularly, the roller set 42 comprises a mating pair of rollers 58 each journalled for rotation in bearing blocks 60 and carried within opposed U-shaped brackets 62. The rollers 58 are formed with semi-circular peripheral surfaces 64 between annular side flanges 66. With the flanges 66 in rolling engagement, the opposed rollers thus define a circular pass therebetween having a diameter equivalent to the outer diameter of the tube 12.

The opposed U-shaped brackets 62 are carried for limited sliding movement toward and away from each other within a box frame 68 formed by spaced side members 70 interconnected by opposite end members 72 secured as by stud bolts 73 (FIG. 5). The side members are provided with longitudinally extending recesses (not shown) for receiving the legs of the U-shaped brackets 62. The U-shaped brackets are confined within the recesses for longitudinal sliding movement within the box frame 68 by means of retainer plates 74 removably secured to the side members 70 as by stud bolts 76. Setscrews 78 threaded through each of the end members 72 bear against the cross member of the adjacent U-shaped bracket 62 for urging the flanges 66 of the opposed rollers 58 into rolling engagement with one another. By manipulating the setscrews the U-shaped brackets and the rollers can be moved to selected locations within the box frame 62, and the proper force can be applied to maintain the side flanges 66 in rolling engagement as the tube 12 is drawn through the passage defined by the peripheral surfaces 64.

The box frame 68 within which the rollers 58 are carried is, in turn, mounted upon the carrier plate 52 for lateral adjustment to selected positions relative to the support framework 46. To that end spaced, parallel, transversely extending guide members 80 are affixed to the carrier plate 52 for receiving flanges of the side members 70 therebetween. Retaining plates 82, secured to the guide members as by stud bolts 84, project over the flanges of the side members 70. The box frame 68 is thus slidably affixed to the carrier plate for movement to selected lateral positions.

As will be hereinafter more fully described, the box frame 68 and the rollers 58 carried therein are adjustably positioned in response to information fed back from the preliminary alignment checker device 22 and the final checking unit 28. A motorized positioning unit, illustrated generally at 86, is provided for appropriately positioning the box frame along the slideway defined by the guide members 80 and the retaining plates 82. The motorized positioning unit includes a reversible motor and gear reduction unit 88 suitably mounted upon a platform 90 affixed to the edge of the support framework 46 and the carrier plate 52. An output shaft 92 from the motor and gear reduction unit is operably coupled to a jack screw unit 94 also mounted on the platform 90. The jackscrew unit includes an axially extendible shaft 96 which is connected at its distal and to the adjacent end member 72 of the box frame 68 (FIG. 6). Thus, upon controlled operation of the motor and gear reduction unit 88 the shaft 96 can be axially extended or retracted to laterally move the box frame 68 and rollers 58 carried thereby to selected positions.

In order to monitor the lateral position of the rollers 58 and hence of the passageway therebetween through which the tube 12 is advanced, a sensing unit 98 is provided. The sensing unit may be of a conventional type which will generate a signal indicative of the lateral position of the rollers relative to a predetermined reference point such as the longitudinal axis of the tube forming mill 10. By way of example, as illustrated in FIG. 6 the sensing unit 98 may comprise a signal-generating body 100 carried by the platform 90. A measuring probe 102 extending through a bushing 104 and the end member 72 of the box frame 68 is urged axially into engagement with the cross member of the U-shaped bracket 62. The probe thus moves axially in response to lateral movement of the rollers, and as it moves axially through the body 100 signals indicative of the position of the rollers are generated for transmission to a central computer. The sensing unit 98 may also, of course, provide a visual indication of the position of the rollers.

As heretofore indicated, the guide roller set 44 and the mounting and adjustment mechanism therefore are generally similar to those of the roller set 42, and it is oriented perpendicular thereto. Thus, the roller set 44 comprises a mating pair of vertically aligned rollers 106. The rollers are journalled for rotation in bearing blocks 108 carried within opposed U-shaped brackets 110. The rollers are formed with semi-circular peripheral surfaces 112 between annular side flanges 114. The U-shaped brackets 110 are carried for limited movement toward and away from one another within a box frame 116 formed by side members 118 interconnected by opposite end members 120. The U-shaped brackets 110 are slideably confined within the box frame by side retainer plates 122 removeably secured to the side members 118 as by stud bolts 124. Setscrews 126 threaded through each of the end members 120 bear against the cross member of the adjacent U-shaped bracket 110.

The box frame 116 is mounted upon the carrier plate 52 for vertical adjustment to selected positions relative to the support framework 46. Flanges of the side plates 118 of the box frame 116 are slideably received between guide members 128 affixed to the carrier plate 52. Retainer plates 130 affixed to the guide members as by stud bolts 132 extend over the flanges of the side members 118 whereby the box frame is constrained for sliding vertical movement between the guide members.

A motorized positioning unit 134 is provided for vertically positioning the box frame 116 and rollers 106 carried thereby along the slideway defined by the guide members 128 and the retainer plates 130. A reversible motor and gear reduction drive unit 136 is suitably mounted upon a platform assembly 138 mounted atop the support plate 52. The platform assembly is supported upon the plate by braces 140 and 142 along the opposite faces of the plate. An output shaft 144 from the motor and gear reduction unit 136 is operably coupled to a jackscrew unit 146. The jackscrew unit includes an axially extendable shaft 148 which is connected at its distal end to the adjacent end member 120 of the box frame 116.

A sensing unit 150 also mounted on the platform assembly 138 includes a signal generating body 152 having a measuring probe 154 extending through a bushing 156 and the end member 120. The measuring probe is urged axially into engagement with the cross member of the U-shaped bracket 110. The probe thus moves axially in response to vertical movement of the box frame 116 and the rollers 106. Signals indicative of the vertical position of the rollers are generated for transmission to the central computer.

After passing through the tube straightener 20 and the preliminary alignment checker 22, the continuous tube 12 enters the cut-off unit 24 where it is cut transversely at periodic intervals into the individual sections 26 of predetermined length. The cut-off unit may be of a standard type used heretofore in the production of continuous seam welded tubing. As each individual section 26 leaves the cut-off unit 24 it is conveyed onto the final checking unit 28. The checking unit may be located some distance beyond the cut-off unit, and the tubes 26 are preferably advanced at an accelerated rate in order to space successive individual sections from one another.

As shown schematically in FIGS. 1 and 3, each section 26 may be advanced as upon a series of driven carrier wheels 158 having a curved peripheral surface configuration to accommodate the tube. The tube section advances until it reaches a predetermined position for removal laterally from the carrier wheels 158. Various devices may be employed for suitably positioning the tube sections and initiating operation of the final checking unit 28. By way of example, the tube section may advance until its leading and engages a stop member 160 incorporating a limit switch which generates a signal causing a suitably programmed computer to initiate an inspection and unloading cycle as will be hereinafter described.

Inclined ramps 162 are provided along either side of the series of carrier wheels 158 for receiving the tube sections 26 therefrom and depositing the sections upon spaced pairs of rotating and ejecting rollers 164 and 166, respectively. Apparatus is provided for laterally displacing the tube sections in one direction or the other from the carrier wheels, whereupon the sections roll down the inclined ramps 162 and are received and cradled between the rotating rollers 164 and the ejecting rollers 166 as shown in FIG. 3. By way of example, a device for laterally displacing the tube sections may suitably comprise an elongated trough, shown generally at 167, suitably mounted beneath the path of the individual tube sections 26 as they advance upon the carrier wheels 158. The trough includes oppositely disposed inclined legs 168 extending from a base 169 mounted for rocking or pivoting movement about an axle 170. A pivot arm 171 extending from the base 169 is pivotally connected to the axially extensible rod 172 of a suitably mounted linear actuator 173. The advancing tube section is received within the elongated trough 167 between the arms 168. Upon activation of the linear actuator to selectively extend or retract the rod 172, the trough will pivot about the axle 170, causing one or the other of the arms 168 to engage the tube section and displace it laterally from the carrier wheels in a predetermined direction for rolling down the associated ramp 162.

In order to correct for any residual curvature in the tube sections 26 observed at the deflection checker 28, it is necessary to correlate the angular position of the section 26 at the checker with the angular position of the continuous tube 12 at the straightening unit 20. To that end, suitable drive units 176 are provided for rotating the rollers 164. The ejecting rollers 166 may be mounted for free wheeling rotation. As a tube section 26 is received from the associated ramp 162 and cradled between the pairs of rollers 164 and 166, the drive units 176 are activated to drive the rollers 164 and, in turn, to rotate the tube section about its longitudinal axis. Suitable detectors 178, such as conventional magnetic type sensors capable of differentiating the weld seam from the remainder of the tube wall, are positioned adjacent the tube. As the tube is rotated and the weld seam passes the detector, a signal is generated stopping the drive unit 166 and discontinuing rotation of the tube with the seam weld 14 in a predetermined position.

With the tube section 26 thus oriented in a known angular attitude relative to the continuous tube 12 at the straightener unit 20, the deviation or deflection from true straightness is measured at the mid region of the tube section. As illustrated in FIG. 4, deflection gauges 180 are positioned to measure deviation of the tube along axes disposed orthogonally to one another. The deflection gauges may be of any suitable type which will indicate the magnitude and direction of the deflection along the axes of the gauges. For example, the gauges may include an axially extensible probe 182 having a tip 184 for bearing against the surface of the tube, with the axial position of the probe being indicative of the magnitude and direction of the deviation of the tube from straightness. The gauge generates a signal indicative of this information for transmission to the central computer. By utilizing the information from the orthogonally positioned gauges 180, the actual magnitude and direction of deviation from the longitudinal axis relative to the continuous tube 12 can be determined and utilized to reposition the pairs of guide rollers 42 and 44 for appropriately deforming the tube to compensate for the curvature so that subsequent sections 26 will be straight.

Provision may be made for applying an identifying indicia to a tube section if it is determined that the amount of curvature is outside predetermined levels of acceptability. For example, a conventional marking unit 185 such as a paint spray unit or stamper may be positioned to apply a suitable colorant to the end of the section 26 if it is determined to be outside acceptable tolerance limits.

While it is contemplated that all of the tube sections 26 may be inspected by a single unit at the checking station 28, two such units are preferably employed, with the tube sections being alternately directed to one side and then the other as shown in FIG. 3. Following alignment and measurement of the individual tube sections while cradled between the rollers 164 and 166, the sections are again laterally displaced so as to roll down a second ramp 186 and onto an adjacent accumulator unit 188. The accumulator unit may, for example, comprise a rack for accommodating a plurality of the tube sections for storage and shipment. It may also comprise a buck upon which an appropriate number of the tube sections are accumulated and then encircled by bands for subsequent handling and shipping as banded units. In order to laterally displace the sections for rolling movement down the ramps 186, the rollers 166 may advantageously be carried by linear actuators 190 such as fluid operated cylinders. The linear actuators have piston rods 192 which may be controllably extended and retracted so that upon completion of a tube rotating and measuring cycle, the appropriate piston rods are advanced to cause the rollers 166 to push the tube 26 up over the rollers 164 for rolling movement down the ramp 186. The rods then retract the rollers 166 for reception of the next tube section from the ramp 162.

Figure 8:
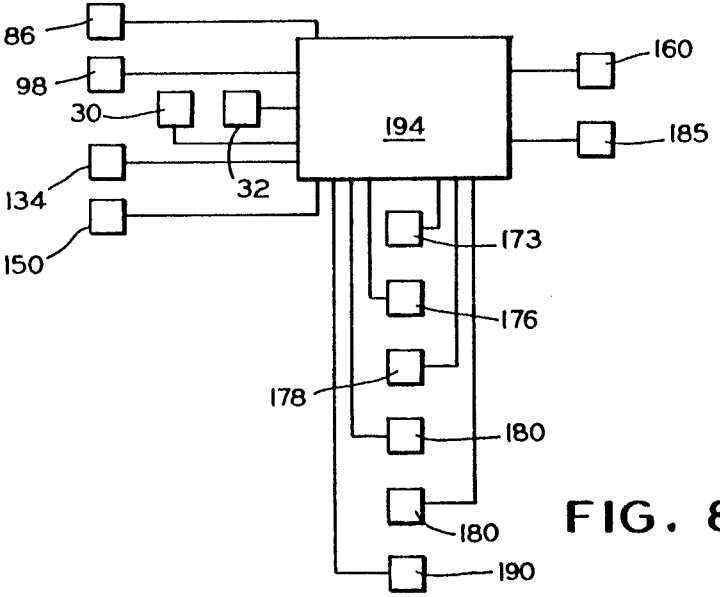
FIG. 8 is a diagram schematically illustrating a suitable control system for the invention.

Briefly reviewing operation, as shown schematically in FIG. 8 the various components of the invention may be operably connected to a suitably programmed computer 194 in a conventional manner. The newly formed continuous tube 12 exits the straightener unit 20 and passes through the horizontal and vertical scanner units 30 and 32, respectively. The scanner units observe the actual position of the tube and send corresponding signals indicative of the position to the computer 194. The observed position is compared to the predetermined desired position. Appropriate signals are sent by the computer to the motorized positioning units 86 and 134 in response to noted deviations outside acceptable limits, to adjust the position of the pairs of guide rollers 42 and/or 44 to deform the tube and cause it to subsequently assume the desired position as it passes through the scanner units.

The advancing continuous tube 12 is cut into individual sections 26 by the cut-off unit 24. The individual sections are then advanced onto the final checking unit 28 in succession. At the appropriate location the advancing individual sections 26 activate the stop and cycle member 160, sending a signal to the computer to initiate the final checking cycle. The linear actuator 173 is then activated to pivot the trough 167 and direct the tube section down the selected one of the inclined ramps 162 for cradling between the rotating rollers 164 and the ejecting rollers 166. The drive units 176 for the rotating rollers are activated to rotate the tube section about its longitudinal axis until the seam weld 14 reaches a predetermined position as determined by the seam detector 178.

With the tube section 26 properly oriented, the deflection gauges 180 are activated to sense the position of the adjacent tube wall and hence detect the amount and direction of any residual curvature in the tube section. Signals indicative of the magnitude and direction of the observed curvature or deflection are sent to the computer 194. If curvature outside predetermined limits is observed, signals are sent to the motorized positioning units 86 and 134 for appropriately repositioning the guide roller sets 42 and 44 to eliminate the curvature. Should the deflection noted by the gauges 180 be outside acceptable limits, the computer may send a signal to the marking unit 185 for application of a visible identifying indicia to the adjacent end of the section.

Upon completion of measurement of deflection by the gauges 180, the linear actuators 190 extend the rods 192 and ejecting rollers 166, causing the tube section to roll down the ramp 186 and onto the accumulating unit 188. While a tube section is being inspected on one side of the checking unit 28, the succeeding tube section may, of course, be moved into position for inspection on the opposite side of the checking unit. It is also contemplated that in order to accommodate the individual tube sections at higher line speeds, final checking units may be located in tandem along the production line. It will thus be apparent that in accordance with the invention, production of pipes or tubes by the continuous seam-welded process having a high degree of axial straightness is assured.

It is to be understood that the forms of the invention herewith shown and described are to be taken as illustrative embodiments only of the same, and that various changes in the shape, size and arrangement of parts, as well as various procedural changes, may be resorted to without departing from the spirit of the invention.

What is claimed is:

1. A method of straightening continuous seam-welded tube wherein the formed and welded tube advances along a path through a straightener between first and second pairs of opposed rollers and thereafter through an alignment checker, the first and second pairs being disposed along axes substantially perpendicular to one another, comprising determining the actual position of the outer surface of the advancing tube within the alignment checker relative to a predetermined desired position therein, generating a signal indicative of the deviation of the actual position from the desired position, and adjusting the positions of the first and second pairs of opposed rollers along the axes in response to said signal to bend the tube within the straightener so that the outer surface of the tube tends to assume the predetermined desired position at the alignment checker.

2. Apparatus for straightening continuous seam welded tube advancing axially along a path, comprising a straightening unit through which the formed and welded tube is continuously advanced, the straightening unit including first and second pairs of cooperating guide rollers through which the tube successively passes, means mounting said first pair of guide rollers for adjustment in a first direction substantially normal to the path of the tube, means mounting said second pair of guide rollers for movement in a second direction substantially normal to the path of the tube and substantially perpendicular to said first direction, alignment checking means for determining the actual position of the outer surface of the advancing tube relative to a predetermined desired position after the tube leaves the straightening unit, and means for adjusting said first pair of guide rollers in said first direction and said second pair of guide rollers in said second direction in response to observed differences between the actual and desired positions of the outer surface of the tube for deforming and directing the advancing tube toward the desired position.

3. A method of straightening continuous seam-welded tube wherein the formed and welded tube advances along a path through a straightener between first and second pairs of opposed rollers and thereafter through an alignment checker, comprising determining the actual position of the outer surface of the advancing tube within the alignment checker relative to a predetermined desired position therein, generating a signal indicative of the deviation of the actual position from the desired position, and adjusting the positions of the first and second pairs of opposed rollers in response to said signal to bend the tube within the straightener so that the outer surface of the tube tends to assume the predetermined desired position at the alignment checker, including determining the actual position of the tube within the alignment checker in a plane substantially normal to said path and along axes normal to one another.

4. A method of straightening continuous seam-welded tube wherein the formed and welded tube advances along a path through a straightener between first and second pairs of opposed rollers and thereafter through an alignment checker, comprising determining the actual position of the outer surface of the advancing tube within the alignment checker relative to a predetermined desired position therein along axes normal to one another in planes substantially normal to said path, generating a signal indicative of the deviation of the actual position from the desired position, and adjusting the positions of the first and second pairs of opposed rollers in directions normal to one another in response to said signal to bend the tube within the straightener so that the outer surface of the tube tends to assume the predetermined desired position at the alignment checker.

5. A method of straightening continuous seam-welded tube wherein the formed and welded tube advances along a path through a straightener between first and second pairs of opposed rollers and thereafter through an alignment checker, comprising determining the actual position of the outer surface of the advancing tube within the alignment checker relative to a predetermined desired position therein, generating a signal indicative of the deviation of the actual position from the desired position, adjusting the positions of the first and second pairs of opposed rollers in response to said signal to bend the tube within the straightener so that the outer surface of the tube tends to assume the predetermined desired position at the alignment checker, cutting a section of tube of predetermined length from said continuous tube, locating the angular orientation of the seam weld of said section, measuring the amount and direction of lateral displacement of said tube section at a point intermediate the opposite ends of the section and at a predetermined relationship to the angular orientation of the seam weld, generating a second signal indicative of the amount and direction of the displacement, and adjusting the positions of the first and second pairs of opposed rollers in response to the second signal to straighten the tube whereby curvature in sections of tube subsequently cut from said continuous tube is minimized.

6. A method of straightening continuous seam welded tube as claimed in claim 5, wherein the section of predetermined length is cut as said tube continuously advances, including displacing the tube section laterally away from the path of the continuous tube by rolling the tube section along a ramp for reception in an inspection cradle means.

7. A method of straightening continuous seam welded tube as claimed in claim 6, including rotating the section of tube about its longitudinal axis within the cradle means to locate the seam weld in a predetermined angular orientation for orienting the tube section relative to the continuous tube.

8. A method of straightening continuous seam welded tube as claimed in claim 7, wherein with the seam weld located in the predetermined angular orientation, lateral displacement of the tube section from a straight line is measured at a position intermediate the ends of the tube section along a pair of axes substantially perpendicular to one another.

9. Apparatus for straightening continuous seam welded tube advancing axially along a path, comprising a straightening unit through which the formed and welded tube is continuously advanced, the straightening unit including first and second pairs of cooperating guide rollers through which the tube successively passes, means mounting said first pair of guide rollers for adjustment in a first direction substantially normal to the path of the tube, means mounting said second pair of guide rollers for movement in a second direction substantially normal to the path of the tube ad substantially perpendicular to said first direction, alignment checking means for determining the actual position of the outer surface of the advancing tube relative to a predetermined desired position after the tube leaves the straightening unit, the alignment checking means including first position sensor means determining the actual position relative to the desired position along a first axis substantially normal to the longitudinal axis of the tube and second position sensor means determining the actual position relative to the desired position along a second axis substantially perpendicular to said first axis, and means for adjusting said first pair of guide rollers in said first direction and said second pair of guide rollers in said second direction in response to observed differences between the actual and desired positions of the outer surface of the tube for deforming and directing the advancing tube toward the desired position.

10. Apparatus for straightening continuous seam welded tube as claimed in claim 9, wherein said first and second position sensor means comprise laser scanners including means generating signals indicative of the actual position of the tube relative to the desired position.

11. Apparatus for straightening continuous seam welded tube as claimed in claim 10, wherein said means for adjusting said guide rollers includes positioning units operably connected to said first and second pairs of guide rollers, said positioning units being responsive to said signals for adjusting the positions of said pairs of guide rollers.

12. Apparatus for straightening continuous seam welded tube advancing axially along a path, comprising a straightening unit through which the formed and welded tube is continuously advanced, the straightening unit including first and second pairs of cooperating guide rollers through which the tube successively passes, means mounting said first pair of guide rollers for adjustment in a first direction substantially normal to the path of the tube, means mounting said second pair of guide rollers for movement in a second direction substantially normal to the path of the tube and substantially perpendicular to said first direction, alignment checking mans for determining the actual position of the outer surface of the advancing tube relative to a predetermined desired position after the tube leaves the straightening unit, means for adjusting said first pair of guide rollers in said first direction and said second pair of guide rollers in said second direction in response to observed differences between the actual and desired positions of the outer surface of the tube for deforming and directing the advancing tube toward the desired position, a cut-off unit disposed along said path following said alignment means for severing said continuous tube into individual tube sections of predetermined length, means for advancing said individual tube sections one after another from said cut-off unit, and a deflection checking and accumulating unit for receiving the individual tube sections one after another, said checking and accumulating unit including means for determining the lateral displacement at an intermediate point of an individual tube section relative to the ends thereof.

13. Apparatus for straightening continuous seam welded tube as claimed in claim 12, wherein said deflection checking and accumulating unit includes means for rotating individual tube sections about their longitudinal axis for locating the seam weld of the section in a predetermined position relative to the seam weld of the continuous tube.

14. Apparatus for straightening continuous seam welded tube as claimed in claim 12, wherein said deflection checking and accumulating unit includes first and second pairs of rollers spaced from one another and longitudinally aligned with and laterally displaced from said means for advancing the individual tube sections, the rollers of each said pair being positioned to define a cradle for rollingly supporting a said individual tube section therebetween.

15. Apparatus for straightening continuous seam welded tube as claimed in claim 14, including downwardly inclined ramp means disposed between said means for advancing said individual tube sections and said first and second pairs of rollers, and means for laterally displacing a said tube section from said means for advancing whereby said tube section rolls down said ramp and is cradled between said pairs of rollers.

16. Apparatus for straightening continuous seam welded tube as claimed in claim 15, including ramp means and first and second pairs of rollers disposed along each side of said means for advancing, said means for laterally displacing being adapted to selectively displace tube sections to each said ramp means.

17. Apparatus for straightening continuous seam welded tube as claimed in claim 14, including drive means for rotating at least one of said rollers for rotating a tube section cradled between said rollers about its longitudinal axis, detector means positioned to detect the seam weld as the tube section rotates, and means stopping rotation of the tube section with the seam weld in a predetermined position in response to a signal from said detector means.

18. Apparatus for straightening continuous seam welded tube as claimed in claim 17, including deflection gauge means positioned for measuring displacement from axial alignment intermediate the opposite ends of a tube section cradled in said first and second pairs of rollers.

19. Apparatus for straightening continuous seam welded tube as claimed in claim 18, wherein said deflection gauge means measures displacement from axial alignment along two radial axes disposed at substantially a right angle to one another.

20. Apparatus for straightening continuous seam welded tube as claimed in claim 19, wherein said deflection gauge means includes means generating second signals indicative of the magnitude and direction of the measured deflection and transmitting the signals to the means for adjusting the guide rollers, said means for adjusting the guide rollers including positioning units operably connected to said first and second pairs of guide rollers, said positioning units being responsive to said second signals for adjusting the positions of said pairs of guide rollers.

* * * * *